US005692321A

United States Patent [19]

Holstine

[11] Patent Number: 5,692,321

[45] Date of Patent: Dec. 2, 1997

[54] ATHLETIC BOOT

[76] Inventor: Michael P. Holstine, 10230 - 34th Ave. SW., Seattle, Wash. 98146

[21] Appl. No.: 570,909

[22] Filed: Dec. 12, 1995

[51] Int. Cl.[6] ..... A43B 7/14; A43B 5/04

[52] U.S. Cl. ..... 36/93; 36/29; 36/10; 36/116; 36/117.6

[58] Field of Search ..... 36/10, 29, 55, 36/88, 93, 115, 116, 117.1, 117.6, 72

[56] References Cited

U.S. PATENT DOCUMENTS

| | | | |
|---|---|---|---|
| D. 272,484 | 2/1984 | Sartor | 36/117.1 |
| 3,693,270 | 9/1972 | Murray | 36/71 |
| 4,361,969 | 12/1982 | Vermonet | 36/88 |
| 4,505,056 | 3/1985 | Beneteau | 36/117.6 |
| 4,662,087 | 5/1987 | Beuch | 36/88 |
| 4,995,173 | 2/1991 | Spier | 36/29 |
| 5,203,793 | 4/1993 | Lyden | 36/88 |
| 5,257,470 | 11/1993 | Auger et al. | 36/88 |
| 5,353,525 | 10/1994 | Grim | 36/88 |
| 5,435,080 | 7/1995 | Meiselman | 36/115 |
| 5,444,926 | 8/1995 | Allen et al. | 36/93 |

FOREIGN PATENT DOCUMENTS

| | | | |
|---|---|---|---|
| 1597283 | 7/1970 | Germany | 36/117.6 |
| 2845824 | 5/1979 | Germany | 36/93 |

*Primary Examiner*—M. D. Patterson

*Attorney, Agent, or Firm*—Vance, Romero & Montague, P.S.

[57] ABSTRACT

An improved athletic boot, such as a snowboard boot, snow ski boot, and the like, having: an outer boot comprising an outer shell or housing, an inner boot positioned within the outer boot for receipt and cushioning of an athlete's foot and ankle, and structure for absorbing and redirecting impact compression force and energy attendant thereto to provide variable support for an athlete's foot and/or ankle.

32 Claims, 9 Drawing Sheets

ATHLETIC BOOT

COPYRIGHT NOTICE

©Copyright 1995, James R. Vance. All Rights Reserved.

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyrights whatsoever.

TECHNICAL FIELD

This invention relates to athletic footwear and, more particularly, to athletic boots comprising snowboard boots, snow ski boots, and the like.

BACKGROUND ART

Athletic sports, such as snowboarding and snow skiing, often place dramatically increased forces and stresses upon the feet, ankles, and legs of athletes. For example, it is not uncommon during a ski season for one or more skiers to break a leg upon traveling down even a mildly inclined ski slope.

The exposure for foot, ankle, and leg injuries is significantly increased for athletes of snowboarding. There are several reasons for an increased danger to snowboarders. Such reasons include the design of the snowboard, manner within which the snowboard is used, design of the binding which holds the snowboard boot to the snowboard, and the design of snowboard boots.

For example, downhill skis and cross-country skis utilize an upwardly extending camber throughout the majority of their length. Such camber allows the ski to function as an elongated spring or shock absorber. In essence, the shape and function of downhill skis and cross-country skis are similar to the shape and function of the rear springs found on antique automobiles and farm equipment which are designed to absorb impact forces.

Snowboards are by definition significantly shorter and wider than downhill skis and cross-country skis. Consequently, snowboards are not long enough to accommodate a dramatic upwardly extending camber. In other words, there is less of a length within which the snowboard can carry an upwardly directed camber to function as a shock absorber. Without such a dramatic camber the snowboard will not function like an arched spring. All or nearly all of the impact forces exerted upon the snowboard will be transmitted directly to the snowboard boot and athlete.

Due to their shortened length and increased width, snowboards are significantly stiffer than downhill skis and cross-country skis. This also negatively affects the snowboard and prevents the snowboard from absorbing impact forces during operation.

Originally the snowboard was attached to the athlete by simply strapping or tying a mounting bracket that was rigidly secured to the snowboard to whatever footwear the athlete was wearing. Unfortunately, such binding apparatus did not have any breakaway features. All forces that were imparted to the snowboard during a performance were directly communicated to the athlete's boot via such unyielding strapping. It is not surprising that many athletes suffered nearly crippling injuries due to these crude means of attachment.

Although there has been some progress in the area of using strapless bindings within the snowboarding sport, the problem of directly communicating the forces exerted upon the snowboard to the athlete's boot remains the same.

It is very common within the snowboarding sport to see athletes grabbing or holding onto a portion of the snowboard during operation thereof. This is particularly true during the performance of tricky maneuvers, such as jumps, air turns, and the like. A result of such usage is that the knees of the athlete are commonly pivoted very much forward toward the front or tip of the snowboard. However, upon landing after a jump or other airborne maneuver, the weight of the athlete is shifted rearwardly and a greater force is exerted by the athlete upon the rearward portions of the snowboard in order to maintain balance and prepare for the next maneuver.

This constant rocking motion between a forwardly inclined knee position and thrusting of the rearward portions of the snowboard into the terrain, often cause chaffing of the athlete's legs and ankles within the athlete's snowboard boots. Consequently, it is the usual practice among snowboard athletes to wear looser tied snowboard boots, thereby providing additional room for maneuvering movement.

After an airborne maneuver, the impact of landing upon the terrain is communicated or transmitted from the non-shock-absorbent snowboard directly into the athlete's snowboard boot. Such impacts can be very significant and dangerous, depending upon the height of the jump, weight of the athlete, density of the underlying snow, angle of landing, and position of the athlete's weight when the impact occurs.

This danger is dramatically intensified if the athlete is wearing loose snowboard boots. The weight of the athlete can shift due to the movement of the athlete's feet within the boots. This causes the athlete to have a weak or loose footing for landing. Furthermore, the athlete's feet may actually slide and twist within the boot causing tendon and/or bone damage to the athlete's toes, foot arches, ankles, and/or legs. In essence, heretofore, the tightness, support, safety, and security provided by the snowboard boot had to be reduced or compromised in order to provide the athlete maneuvering room during performance.

Heretofore, snowboard boots were designed in two primarily different styles. The first style was a soft boot made from adhering, sewing, or lacing several layers of materials together to provide support to the athlete's foot. Examples of such soft boots are conventional cross-country ski boots made of leather and conventional snow boots made of thick felt contained within an outer shell of rubber and nylon.

Due to the usage of soft flexible materials within a soft boot, very little support or protection is provided for the ankle or foot of the athlete. This is particularly true for impacts encountered while the athlete is performing carving and/or jump-landing maneuvers.

Soft boots simply do not impart sufficient rigidity or strength to prevent undue stress to be exerted upon the ankle and foot of the athlete. Consequently, within soft boots used in snowboarding increased lateral mobility usually amounts to increased injuries.

In addition, soft boots are traditionally affixed or secured to the snowboard by the aforementioned improperly designed, unyielding bindings or restraints. The bindings or restraining straps restrict the lifting motion of the top of the instep region of the athlete's foot, thus retarding the natural shock absorbing properties of the foot. Soft boots also do not provide sufficient stability or rigidity for the type of exertions typically imparted when participating in the snowboarding sport. The result is extreme foot, ankle, and/or leg fatigue.

The second style of snowboard boot is a hard boot manufactured of molded plastics. Hard boots are very similar to conventional downhill ski boots. Hard boots decrease foot and ankle fatigue by encapsulating the foot to restrict or suppress movement of the foot therein. The hard boot also enables repositioning of the bindings or binding assembly underneath the hard boot. In essence, when a hard boot is used, the foot becomes a rigid extension of the leg.

Even though hard boots are intended to decrease foot and ankle fatigue, maneuverability for the athlete is sacrificed and leg injuries are still likely to occur when conventional hard boots are used. In other words, while continuous ankle immobilization by use of a hard boot may reduce foot and ankle fatigue, mobility necessary for manipulating the boot to perform aerial maneuvers is also dramatically limited.

To properly accomplish aerial maneuvers, the athlete must overcome the inflexibility of the hard boots. This may be accomplished by either loosening the attachment of the hard boots to the athlete, i.e., loosening the laces, ties, or latches of the hard boot, or by over-stressing the hard boot during such maneuvers. If the hard boots are loosened, the athlete may slip and slide within the boots and will have unstable footing throughout the performance. The athlete will also experience chaffing, rubbing, and the attendant pain and results of sores, blisters, and the like.

If the hard boots are over-stressed, the athlete must expend additional energy to bend the hard shells of the boots. This assumes that such hard shells are even capable of being bent. The inflexibility of the hard boot exposes the athlete to additional joint and tendon stress and trauma due to over exertion and will likely fatigue the athlete much sooner than would otherwise occur. In essence, when using hard boots the athlete will likely experience tendon and joint stress related injuries due to the inflexibility of hard boots.

Hard boots are also usually significantly heavier than soft boots. During an active day of snowboarding, use of heavy hard boots will adversely effect the athlete's performance and endurance.

For the above-mentioned reasons snowboard athletes usually prefer to use soft boots, rather than hard boots. Soft boots enable a maximum amount of maneuverability. Most snowboard athletes prefer increased maneuverability even at the expense of loss of safety and support.

Heretofore, neither soft boots nor hard boots had ample shock absorption to enable snowboard athletes to make jumping maneuvers of about forty feet (40') or greater.

Inner boot liners for soft boots and hard boots would simply be inserted into the outer shell of the boot and would rest upon the interior surface of the boot sole. Thus retained in position, the combination of the inner boot liner and the outer shell provides whatever stability and shock absorption that can be imparted by the materials used within the boot.

Although some snowboard boots incorporate softer mid-sole materials therein to partially absorb some impact forces, such boots still dramatically limit the degree of lateral mobility available to the athlete. Athletes often consider this tradeoff as undesirable. For example, lateral mobility transfers directly into ankle instability due to the lack of ankle support. The athlete's ankles need additional support to enable proper carving out of turns and for accomplishing jumps. Without proper ankle support, vertical impacts can lead to compound fractures of the feet, ankles, and/or legs. Compound fractures generally occur when vertical impacts are localized and not dispersed or absorbed over a wide surface.

The inventor believes that the above-listed devices taken alone or in combination neither anticipate nor render obvious the present invention. The listed devices do not constitute an admission that such disclosures are relevant or material to the present Claims. Rather, the listed devices relate only to the general field of the disclosure and are cited as constituting the closest art of which the inventor is aware.

DISCLOSURE OF INVENTION

The present invention comprises an improved athletic boot having means for absorbing and redirecting impact compression forces and energy attendant thereto to provide variable support for an athlete's foot and ankle. In other words, it is the principal objective of this invention to provide an improved athletic boot, where additional support is acquired through absorption of impact energy.

It is the intention of the inventor that the present invention be used within the snowboarding and snow skiing sports to enhance the performance of athletes and to prevent injuries. For these reasons, the present invention is illustrated below as applied to snowboard boots, snow ski boots, and the like. However, this invention could be used in any sport and within any footwear that could benefit from the particular features and/or structure as explained herein.

The present invention is easily constructed and is inexpensive and economical to manufacture. Once manufactured, the present invention is easily adjusted and would not require an alteration of traditional snowboarding or snow skiing techniques as currently used within such sports. The present invention is compact, efficient, reliable, durable, rugged, easily cleaned, and is simple to use.

The present invention eliminates the need for the athlete to loosen the snowboard boot or ski boot prior to a performance in order to provide adequate space for maneuverability. The present invention also eliminates the need for the athlete to overly tighten the snowboard boot or ski boot prior to a performance in order to obtain sufficient foot and ankle support and provide proper footing. Consequently, the present invention is dramatically more comfortable to wear during a performance and does not expose the athlete to increased injury.

The present invention provides athletes with a snowboard boot and/or a ski boot having: greater flexibility than was heretofore available; maximum support and stability when impact compression forces are exerted thereupon; an ability to produce less fatigue, thereby extending the athlete's performance periods; increased safety; and a structure that is designed to eliminate and/or minimize foot and ankle injuries to the athlete.

Some other advantages provided by the present invention include:

(a) automatically securing and providing strength to the foot and ankle of the athlete when an impact or operational force is applied to the athlete's foot and/or outer boot;

(b) providing an increased range of ankle flexibility across the girth and metatarsal regions or areas of the athlete's foot when the impact or operational force is removed from the athlete's foot and/or outer boot;

(c) absorbing and dissipating shock forces from substantially vertical impacts via use of softer shock absorbing materials in the mid-sole of the boot to gain added vertical impact resistance and to distribute the load over a generally larger horizontal plane or area of the athlete's foot and transmit the dissipated shock force energy into a stabilized and supported ankle region of the athlete;

(d) stabilizing footing of an athlete by use of redirecting fluids contained within a bladder assembly;

(e) enabling an athlete to use softer mid-sole materials for added shock absorption without significant deformation or compacting of such materials;

(f) providing an athletic boot having the flexibility of a soft boot while performing airborne maneuvers and the support and stability of a hard boot when landing on the ground;

(g) permitting an immediate and automatic transfer of force from complete support to very little support when called upon by the actions of the athlete;

(h) providing support and stability to the athlete proportional to the downward pressure applied to the athletic boot; and (i) providing superior control of a snowboard or snow ski for the varying ground conditions encountered by the athlete.

In addition to the foregoing advantages, and other advantages that will be described further below, the present invention also overcomes all of the previously mentioned disadvantages.

To achieve these general and specific objectives, the present invention generally comprises an improved athletic boot having: (a) an outer boot which defines an outer or lower shell or housing; (b) an inner boot positioned within the outer boot for receipt and cushioning of an athlete's foot; and (c) means for absorbing and redirecting impact compression forces and energy attendant thereto to provide variable support for an athlete's foot and/or ankle.

The outer boot has an exterior outsole, an opposed interior insole, and attached sidewalls. The sidewalls define a boot upper for the outer boot. The interior insole and sidewalls of the outer boot define a first enclosure into which the inner boot is inserted. The outer boot also has an opening into the first enclosure. The outer boot may also have means for at least partially closing or tightening the opening into the first enclosure.

The inner boot is positioned within the first enclosure. The inner boot also has an outsole, an opposed insole, and attached sidewalls. The sidewalls define a boot upper for the inner boot. The insole and sidewalls of the inner boot define a second enclosure that is capable of receiving the foot of the athlete. The inner boot also has an opening into the second enclosure. The inner boot may have means for at least partially closing or tightening the opening into the second enclosure. The inner boot can also be provided with other means for cushioning the foot of the athlete, such as using padding or a liner material, or the like.

The means for absorbing and redirecting impact compression forces provide addition support of the foot of the athlete by causing such forces exerted upon or against the outsole of the outer boot to change the inflation or enlargement of various portions of a bladder mechanism that is placed about the athlete's foot. As used herein, the words "absorbing and redirecting means," "bladder assembly," "bladder mechanism," and/or similar verbiage, can be used interchangeably.

More particularly, the absorbing and redirecting means has an inflatable lower bladder that is positioned between the insole of the inner boot and the outsole of the outer boot. In essence, the lower bladder forms a footing platform upon which the foot is placed and the athlete stands during performance.

The absorbing and redirecting means also has an inflatable upper bladder positioned between an interior surface of the sidewalls of the inner boot and the foot of the athlete when the improved athletic boot is worn. An interior of the lower bladder communicates with an interior of the upper bladder. It is the general intention of the inventor that the bladder assembly be at least partially juxtaposed between the outer boot and the inner boot.

More particularly, the inventor prefers to position the inflatable upper bladder at least partially over an arch of the foot of the athlete. The inventor prefers to position at least a portion of the inflatable upper bladder over a heel of the foot of the athlete. Furthermore, the inventor prefers to position the inflatable upper bladder at least partially under the ankle of the foot of the athlete.

The absorbing and redirecting means can be inserted into the inner boot. Alternatively, the absorbing and redirecting means can be at least partially attached to or formed integrally within the inner boot. For example, the lower bladder can be partially attached to or formed integrally within the inner boot between the insole and the outsole of the inner boot.

The lower bladder can also incorporate the use of an internal spring to bias the lower bladder toward an unloaded position when the absorbing and redirecting means is in an unloaded position.

In the preferred embodiment of the present invention, the opening into the first enclosure of the outer boot is not positioned substantially above the ankle of the athlete when the athletic boot is worn. This allows an elongated cuff, backstay, or tendon of the inner boot to extend substantially above the ankle of the athlete and the opening into the first enclosure when the athletic boot is worn.

If desired, the elongated cuff, backstay, or tendon guard of the inner boot can include a flexible portion which permits the athlete to lean forward when wearing the athletic boot. The flexible portion of said inner boot is generally positioned above the opening into the first enclosure of the outer boot when the boot is in an unloaded position. However, when the boot is placed into a loaded position, the flexible portion of the inner boot is positioned at least partially below the opening into the first enclosure of the outer boot.

The sidewalls of the outer boot can also be provided with at least one channel therein. The inner boot can also be provided with at least one pin attached thereto or formed integrally therewith. When the absorbing and redirecting means is in a loaded position, to further restrict movement of the inner boot with respect to the outer boot, the pin of the inner boot can operably engage the channel of the outer boot. Thus positioned, the inner boot may not move forward with respect to the outer boot when an operational load is being applied. However, when the operational load or force is removed, the pin of the inner boot will not engage the channel of the outer boot, thereby permitting greater flexibility and maneuverability.

The sidewalls of the outer boot could also be provided with at least one ratchet portion. The sidewalls of the inner boot are also provided with either a matching or meshing ratchet portion or at least one protrusion. If this embodiment is practiced, the matching or meshing ratchet portion, or the protrusion of the inner boot, should operably engage the ratchet portion of the outer boot when the absorbing and redirecting means is in a loaded position, thereby restricting movement of the inner boot with respect to the outer boot. In effect, the absorbing and redirecting means urges the matching or meshing ratchet portion or the protrusion of the inner boot into fixed engagement with the ratchet portion of the outer boot when the absorbing and redirecting means assumes a loaded position. However, if the absorbing and redirecting means assumes an unloaded position, the matching or meshing ratchet portion, or the protrusion of the inner boot, should not operably engage the ratchet portion of the outer boot. The ratchet portions can be serrated if desired.

Within a further alternative embodiment of the present invention, the sidewalls of the inner boot are provided with at least one ratchet portion. The outer boot is provided with at least one pivotal crank which is secured to the outer boot using one or more outwardly projecting flanges and a pin or axle that passes therebetween to function as a fulcrum. When the absorbing and redirecting means assumes its loaded position, the pivotal crank of the outer boot operably engages the ratchet portion of the inner boot to restrict movement of the inner boot with respect to the outer boot. In essence, the absorbing and redirecting means urges the pivotal crank of the outer boot into fixed engagement with the ratchet portion of the inner boot when the absorbing and redirecting means is in its loaded position. However, when the absorbing and redirecting means is in an unloaded position, the pivotal crank of the outer boot should not operably engage the ratchet portion of the inner boot.

In a fourth embodiment of the present invention, the sidewalls of the inner boot are provided with a plurality of linearly spaced indentations or holes. The outer boot is then provided with at least one pivotal crank which has a pin or protrusion thereon which is capable of being inserted into one or more of the indentations or holes on the inner boot. Thus, the pivotal crank can operably engage at least one of the aforementioned spaced indentations or holes, when the absorbing and redirecting means is in a loaded position, to restrict movement of the inner boot with respect to the outer boot. In effect the absorbing and redirecting means urges the pivotal crank of the outer boot into fixed engagement with at least one of said plurality of linerally spaced indentations of the inner boot when the absorbing and redirecting means is in its loaded position. However, when the absorbing and redirecting means is in its unloaded position, the pivotal crank of the outer boot is not operably engaged with any of the indentations of the inner boot.

It is to be understood that irrespective of the embodiment used, the inventor prefers that when an impactive compression force is exerted upon the athletic boot, the inner boot and outer boot are secured together and permit little or no independent movement therebetween. In other words, the inner boot and outer boot are interlocked together.

This locking or interlocking feature or ability also causes the athlete's foot and ankle to become locked and secured as long as a sufficiently forceful impactive compression force is exerted thereupon. The athlete's foot and ankle are so locked or secured by the close packing or inflation of the upper bladder thereagainst.

However, upon removing the impactive compression force, the otherwise flexible inner boot is permitted relatively unobstructed movement within the outer boot.

The preferred and alternative embodiments of the apparatus or structures of the present invention will be further described in greater detail in the following sections of this Specification. However, to avoid any possible confusion as to the scope of the present invention, each of the following sections of this Specification in their entirety is incorporated herein by this reference.

These and other objectives and advantages of the present invention will become more readily apparent upon reading the following disclosure and referring to the attached drawings.

Figure 1:
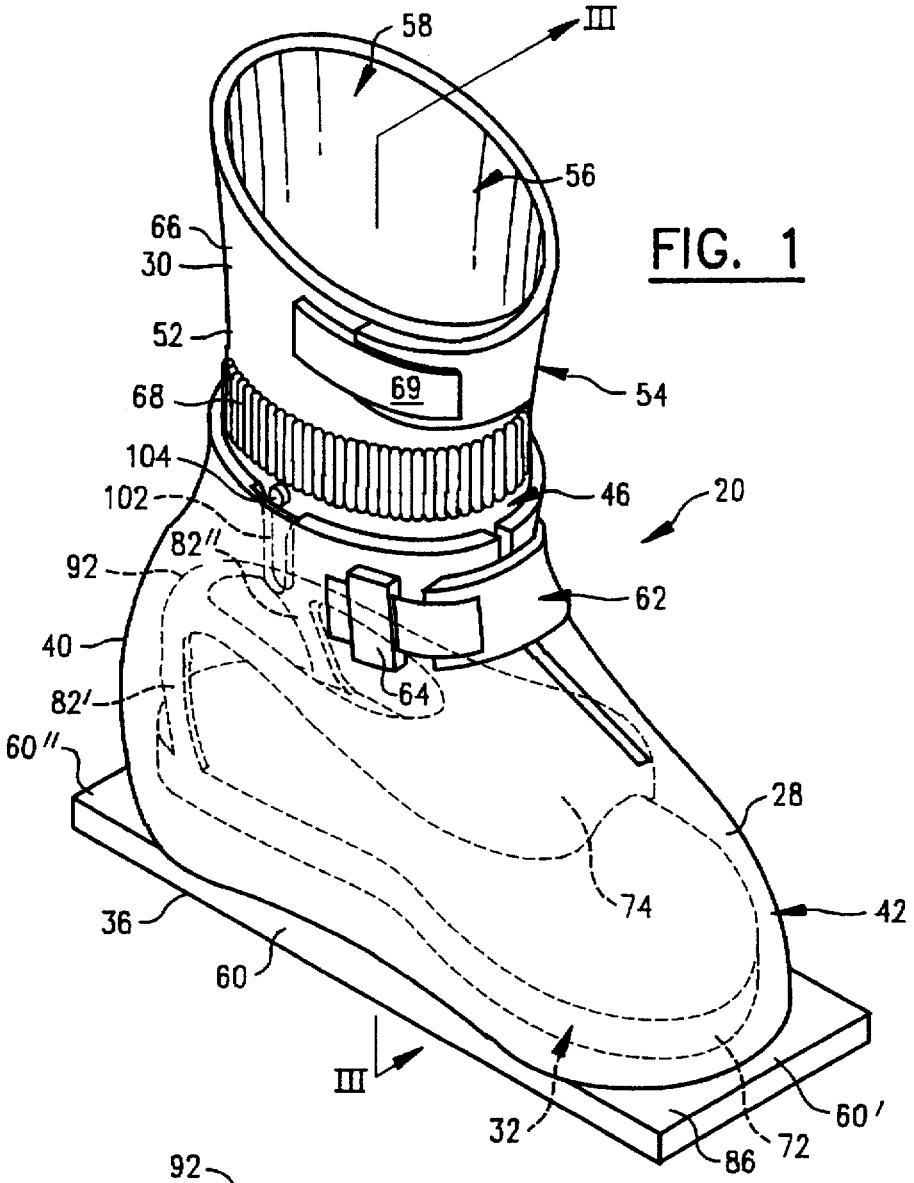
FIG. 1 is an isometric view of a preferred, first embodiment of the present invention with the inner boot placed within the outer boot, and the lower bladder and upper bladder illustrated in dotted lines.

One should understand that the drawings are not necessarily to scale and the elements are sometimes illustrated by graphic symbols, phantom lines, diagrammatic representations, and fragmentary views. In certain instances, the inventor may have omitted details which are not necessary for an understanding of the present invention or which render other details difficult to perceive.

BEST MODE FOR CARRYING OUT THE INVENTION

Referring to the drawings, wherein like numerals indicate like parts, the present invention is an improved athletic boot 20 for placement upon a foot 22 and/or about an ankle 24 of an athlete 26. Athletic boot 20 generally comprises: (a) an outer boot 28 or lower shell; (b) an inner boot 30 or upper shell; and (c) means 32 for absorbing and redirecting impact compression forces 34 that are exerted upon an exterior sole or outsole 36 of outer boot 28, to provide additional support for foot 22 and ankle 24 of athlete 26.

Outer boot 28 has: (a) an exterior outsole 36, (b) an opposed interior insole 38, and (c) attached sidewalls 40. Sidewalls 40 define a boot upper 42 of outer boot 28. Interior insole 38 and sidewalls 40 of outer boot 28 define a first enclosure 44. Near a top of boot upper 42, outer boot 28 has an opening 46 which permits insertion of inner boot 30 into first enclosure 44.

Similarly, inner boot 30 has: (a) an outsole 48, (b) an opposed insole 50, and (c) attached sidewalls 52. Sidewalls 52 define a boot upper 54 for inner boot 30. Insole 50 and sidewalls 52 of inner boot 30 define a second enclosure 56 which is capable of receiving foot 22 of athlete 26. Inner boot 30 also has an opening 58 which permits insertion of foot 22 into second enclosure 56.

During operation of the present invention, inner boot 30 is positioned within first enclosure 44.

If desired, the present invention contemplates that inner boot 30 may be removable from outer boot 28 for purposes of cleaning.

Outer boot 28 and possibly inner boot 30 are preferably manufactured from a material, such as plastic, rubber, fabric, leather, and/or the like, that is capable of resisting fracture when exposed to impact compression force 34. This is preferable because of the physical abuse outer boot 28 in particular may be exposed to during extended use.

Within the preferred embodiment of the invention, outer boot 28 comprises a snowboard boot or a snow ski boot that is capable of being attached to a snowboard 59 or to a ski. Consequently, it is preferred that outsole 36 of outer boot 28 be rigid or at least semi-rigid in strength.

In order to attach outer boot 28 to a snowboard or to a ski, outsole 36 of outer boot 28 has a forwardly projecting and rearwardly projecting sole plate 60 that is capable of being attached to a binding 61 that in turn is secured to the snowboard or ski. Preferably, sole plate 60 has a front lip 60' and a rear lip 60".

Figure 16:
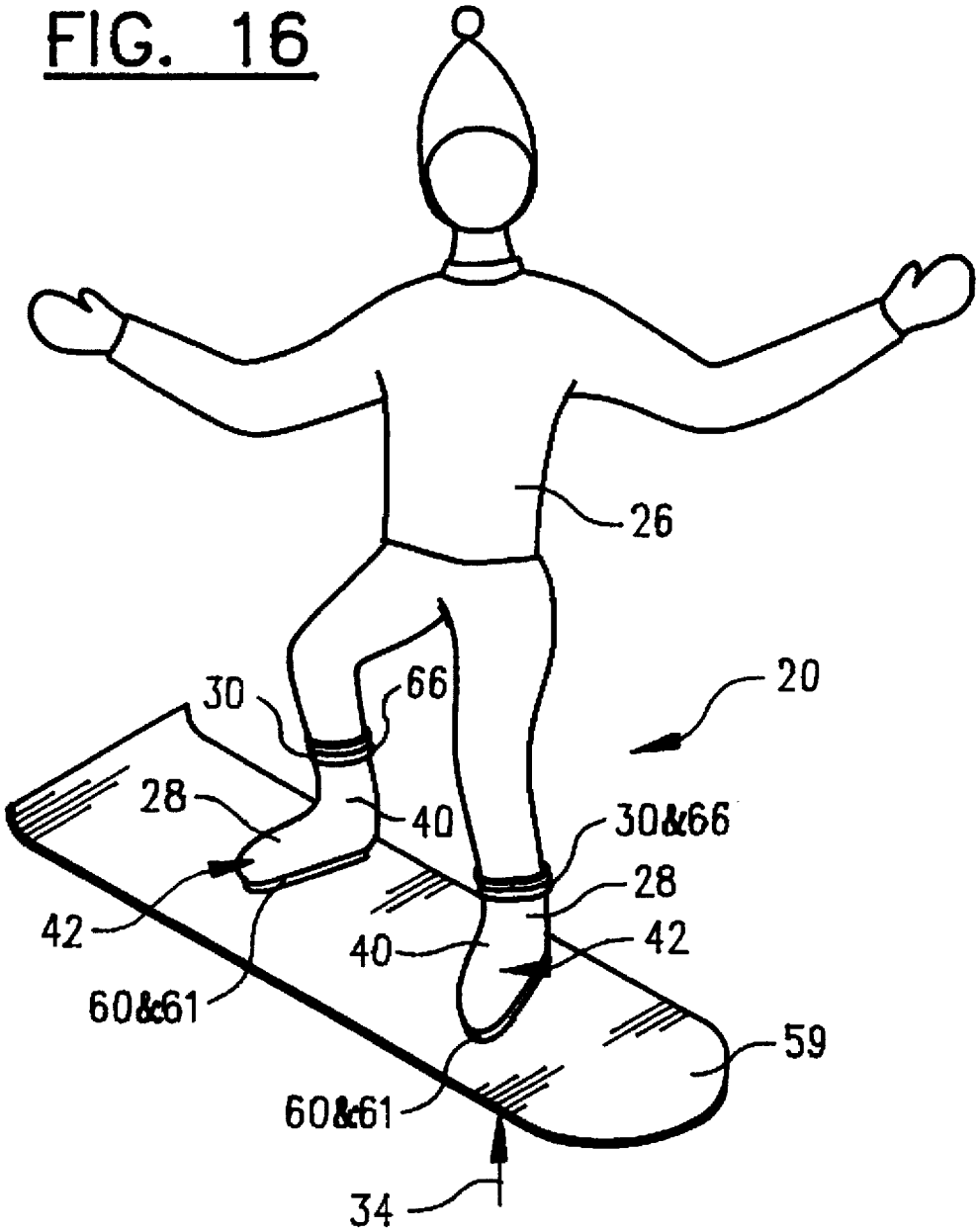
FIG. 16 is a schematic view of an athlete using the first embodiment of the present invention, the invention being affixed to bindings or binding assemblies which are in turn affixed or secured to a snowboard.

Besides the illustration shown in FIG. 16, the inventor believes that snowboards, skis, and bindings for such items are of such notoriety and well known within the art that it is unnecessary to illustrate further or describe such items herein.

It is preferable, however, that forwardly projecting and rearwardly projecting sole plate 60 is formed integrally with sidewalls 40, insole 38, and outsole 36 of outer boot 28. Such integral formation or manufacture thereof can be accomplished through use of an injection molding machine and accompanying mold. Injection molding machines and processes for their use are well established and known in the art. Thus, manufactured, outer boot 28 will be uniform and unitary in construction.

Sole plate 60 or outsole 36 of outer boot 28 may be relatively smooth.

Alternatively, sole plate 60 or outsole 36 of outer boot 28 may be provided with a corrugated, studded, spiked, treaded, or cleated sole to provide greater traction when the snowboard or ski is not worn.

As illustrated in FIG. 1, outer boot 28 can further be provided with means 62 for at least partially closing or tightening opening 46 into first enclosure 44. For example, closing or tightening means 62 can generally comprise one or more buckles, hooks, and/or laces that are threaded through one or more eyelets or eye stays, or the like. FIG. 1 illustrates the use of a single buckle mechanism 64 or fastening clamp to close or tighten opening 46 into first enclosure 44.

Please note that opening 46 into first enclosure 44 of outer boot 28 is preferably not positioned substantially above ankle 24 of athlete 26 when athletic boot 20 is worn. The reason for this preference is to permit a greater amount of flexibility to be imparted to athletic boot 20 during use.

Of course, opening 46 could be positioned above ankle 24 of athlete 26 if the requirements of the sport require or suggest that a greater amount of support should be provided to ankle 24.

For example, as illustrated in FIG. 1, inner boot 30 can be provided with an elongated cuff 66, backstay, or tendon guard which extends substantially above ankle 24 of athlete 26 when athletic boot 20 is worn. Cuff 66, backstay, or tendon guard of inner boot 30 also extends substantially above opening 46 into first enclosure 44 of outer boot 28.

Elongated cuff 66, backstay, or tendon guard of inner boot 30 may also include a flexible portion 68 which permits athlete 26 greater flexibility to manuever, lean forward, lean backward, and/or lean to either side when wearing athletic boot 20.

Similar to outer boot 28, cuff 66 of inner boot 30 may also be provided with means for at least partially closing or tightening opening 58 into second enclosure 56. For example, such closing or tightening means may generally comprise one or more buckles, hooks, and/or laces that are threaded through one or more eyelets or eye stays, or the like. FIG. 1 illustrates the use of a single buckle mechanism 69 or fastening clamp to close or tighten opening 58 into second enclosure 56.

Flexible portion 68 of inner boot 30 is effectively positioned above opening 46 into first enclosure 44 of outer boot 28 when absorbing and redirecting means 32 is in an unloaded position.

However, flexible portion 68 of inner boot 30 is positioned at least partially below a plane defined by opening 46 into first enclosure 44 of outer boot 28 when athletic boot 20 is subjected to impact compression force 34 and absorbing and redirecting means 32 is in a loaded position.

For purposes of clarification, the loaded position is when an impact compressive force or compressive operating weight is applied to athletic boot 20 and to foot 22 of athlete 26.

Please note, however, that use of flexible portion 68 of inner boot 30 as illustrated in FIG. 1 is not absolutely required for operation of the present invention.

It is also preferable that inner boot 30 include means 70 for cushioning foot 22 of athlete 26. Such cushioning means 70 can comprise any appropriate form of padding such as felt or cotton pads, inserts, and the like, or may even comprise another inner boot liner that surrounds foot 22 in a similar fashion as does a sock. Alternatively, lining, padding, and/or cushioning could be provided on interior sidewalls 52 and/or upon insole 50 of inner boot 30. Inner boot 30 could also be provided with a padded tongue.

In essence, insole 50 functions as a foot bed insole for foot 22 of athlete 26.

Focus will now be directed toward the aforementioned means 32 for absorbing and redirecting impact compression force 34 that is exerted upon outsole 36 of outer boot 28 to provide additional support for foot 22 and ankle 24 of athlete 26. Such absorbing and redirecting means 32 generally comprises a bladder assembly having an inflatable lower bladder 72 or lower bladder section and an inflatable upper bladder 74 or upper bladder section.

In essence, the lower bladder 72 is compressed when foot 22 of athlete 26 is forced downward within athletic boot 20.

Lower bladder 72 is positioned between insole 50 of inner boot 30 and outsole 36 of outer boot 28. For example, if necessary, insole 38 of outer boot 28 can function as a bladder bed upon which the bladder assembly rests.

As illustrated within the accompanying Figures, the inventor prefers that upper bladder 74 be positioned between an interior surface 76 of sidewalls 52 of inner boot 30 and foot 22 of athlete 26, when athletic boot 20 is worn.

An interior cavity 78 of lower bladder 72 communicates with an interior cavity 80 of upper bladder 74 via one or more tubes or conduits 82. For example, FIGS. 7, 8, 9, 10, 11, 12, and 13 illustrate one embodiment wherein a single conduit 82 can be positioned at either side or at the back of inner boot 30. FIGS. 1, 2, 3, 4, 5, 6, 14, and 15 illustrate an alternative and preferable embodiment wherein one or more a pair or more of conduits 82 are positioned on each side of foot 22 within inner boot 30.

A fluid 83, such as air or any desirable liquid or viscous aqueous solution, is contained within interior cavity 78 of lower bladder 72 and at least partially within interior cavity 80 of upper bladder 74.

Fluid 83 may be a non-compressible and/or compressible liquid or gas, or combination thereof. Alternatively, fluid 83 may comprise one or more of a combination of non-compressible and/or compressible fluids. Fluid 83 can also be mixed with additives to retard fluid temperature fluctuations. The degree of support, response rate or speed of reaction, and the amount of shock absorption of the bladder assembly can all be varied with the use of different quantities of non-compressible and/or compressible fluids or by the extent to which inner boot 30 is tightened.

Generally speaking, absorbing and redirecting means 32 is at least partially positioned or juxtaposed between outer boot 28 and inner boot 30. For example, absorbing and redirecting means 32 may comprise a separable bladder assembly that can be removed from, or inserted or incorporated into, outer boot 28 and inner boot 30.

Figure 3:
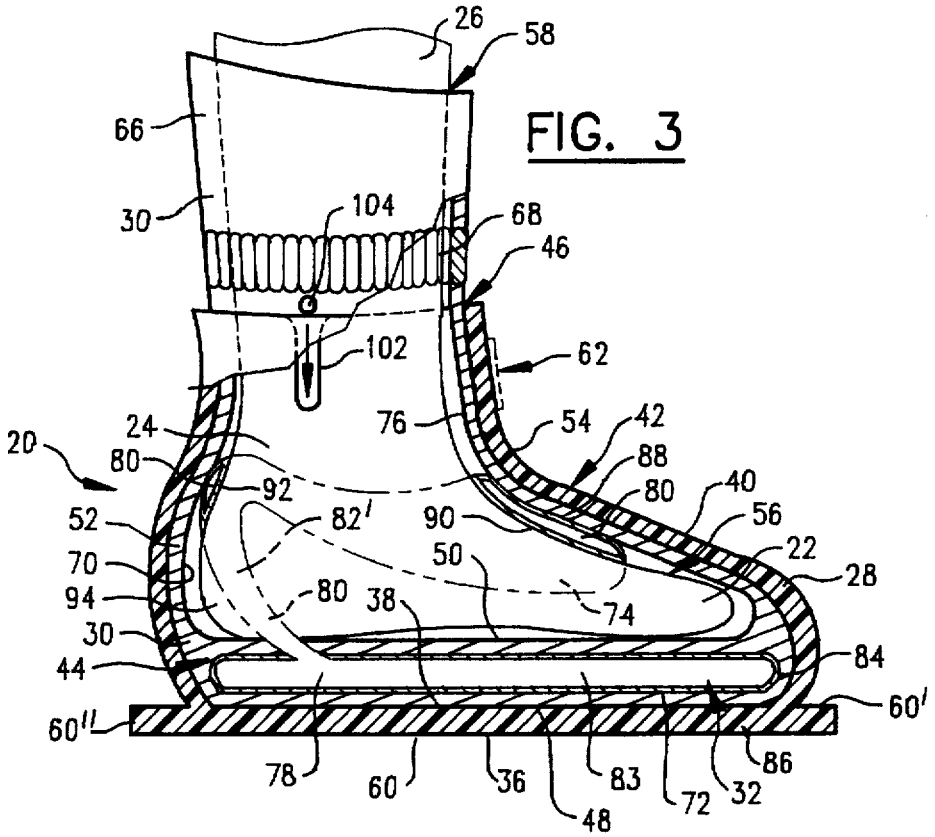
FIG. 3 is a cross-sectional, side-elevational view of the first embodiment of the invention taken substantially along line III—III of FIG. 1, illustrating an outer boot, an interiorly positioned inner boot, and an integral lower bladder juxtaposed between the outer boot and the inner boot. The upper bladder (shown in phantom lines) and the lower bladder are illustrated in an unloaded position.
Figure 4:
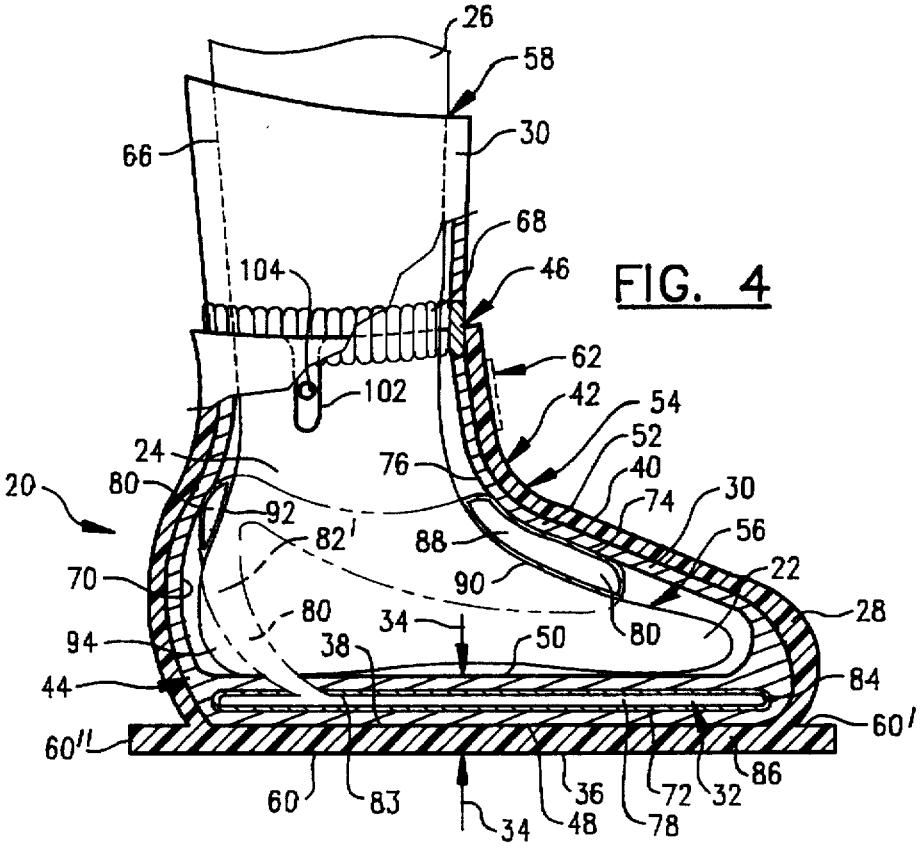
FIG. 4 is a cross-sectional, side-elevational view of the first embodiment of the invention as shown in FIG. 3 with the upper bladder (shown in phantom lines) and the lower bladder illustrated in a loaded position.

Alternatively, as illustrated in FIGS. 3 and 4, absorbing and redirecting means 32 may also be incorporated into a sole 84 of inner boot 30 and still accomplish the purposes of the present invention. In other words, absorbing and redirecting means 32 can be at least partially attached to or formed integrally within inner boot 30 between insole 50 and outsole 48 of inner boot 30.

Although not illustrated, absorbing and redirecting means 32 could similarly and/or alternatively be incorporated into a sole 86 of outer boot 28 and accomplish the purposes of this invention.

Of course sole 84 and sole 86 should have general shape that would accommodate the placement of foot 22 within athletic boot 20.

Referring to FIGS. 3 and 4, a portion 88 of upper bladder 74 is preferably positioned at least partially over an arch 90 of foot 22 of athlete 26. Similarly, a portion 92 of upper bladder 74 can be positioned at least partially over a heel 94 of foot 22 of athlete 26.

Please note that the opposed tubes or conduits 82 which communicate between lower bladder 72 and upper bladder 74 unite together near a rear or heel 94 of foot 22. Consequently, fluid 83 is transmitted from interior cavity 78 of lower bladder 72 to interior cavity 80 of upper bladder 74 through conduits 82 when athletic boot 20 is exposed to impact compression force 34. Because of this union at or near heel 94, each side conduit 82' and 82" of upper bladder 74 is not separated from or urged away from foot 22. Rather, since upper bladder 74 and conduits 82' and 82" are joined at or near heel 94 of foot 22, and upper bladder 74 is confined within inner boot 30, upper bladder 74 is urged against and thereby temporarily restricts the movement of foot 22 within athletic boot 20. This action or feature thereby provides additional support to the upper portions, such as to arch 90, of foot 22 during and immediately after impact compression force 34 is applied to the bottom or outsole 36 of outer boot 28.

For example, when athlete 26 comes down hard after an airborne jump, the underlying snow or ground will limit the distance that outer boot 28 can travel. However, the body of athlete 26 and, more particularly, the legs and feet 22 of athlete 26 still have a downward momentum. Such momentum and impact compression force 34 are transmitted through sole plate 60 and/or sole 86 of outer boot 28. Impact compression force 34 is then exerted upon the exterior surfaces of lower bladder 72. Foot 22 of athlete 26, however, is still traveling downwardly, thereby increasing the exterior pressure exerted upon lower bladder 72. Lower bladder 72 dissipates impact compression force 34 by expelling fluid 83 contained within interior cavity 78 of lower bladder 72 through conduits 82' and/or 82" into interior cavity 80 of upper bladder 74. Interior cavity 80 of upper bladder 74, of course, would have to have sufficient space or expandability to accommodate the increased volume of fluid 83 contained therein.

In effect, lower bladder 72 initially functions as a forgiving brake, shock absorbing pad, and/or bank of fluid mass that can be displaced, thereby dissipating impact compression force 34 exerted thereupon.

Please note that impact compression force 34 is not simply dissipated out into thin air. Rather, impact compression force 34 is redirected hydraulically or pneumatically through conduits 82' and/or 82" that are positioned on each side of lower bladder 72. Fluid 83 contained within conduits 82' and/or 82" is then urged into interior cavity 80 of upper bladder 74 to provide the aforementioned added support to foot 22 by filling the space or void that would otherwise be located above foot 22 within second enclosure 56 of inner boot 30 created by the downward movement or motion of foot 22 within inner boot 30. Consequently, the occupied space within inner boot 30 is basically maintained without there being a large empty space or void created by the downward motion of foot 22 when reacting to the application of impact compression force 34.

This concept may be more easily understood by referring to what is currently being used in the sport. Assume that you have a large enough boot to accommodate placement of a foot and a thick wad of soft flexible material such as foam rubber therebeneath within the boot. If the flexible material is compressed, the void space within the boot is increased due to the compressed nature of the foam rubber. Since a large space is available within the boot above the foot, the foot is not held securely and may slip or slide within the boot, thereby contributing to an injury. After the foam rubber has been compressed repetitively, the foam rubber loses its resiliency. This leaves an ever growing vacant or void space within the boot around or above the athlete's foot. This situation is precisely what the present invention is intending to overcome.

Within the present invention, the movement or displacement of foot 22 can still be accomplished, thereby preventing sudden shock loads or impact loads to foot 22 and the athlete's skeletal bone structure. As foot 22 displaces forces, and/or urges fluid 83 contained within interior cavity 78 of lower bladder 72 to pass through conduits 82' and 82" into interior cavity 80 of upper bladder 74, the void or empty space that would otherwise have occurred above foot 22 is automatically filled by the increasingly filled upper bladder 74. Consequently, foot 22 does not slip or slide within inner boot 30. Rather, foot 22 and ankle 24 are secured and strengthened, thereby avoiding and preventing injuries to athlete 26.

To provide this additional strength and rigidity to ankle 24, upper bladder 74 is positioned at least partially under ankle 24 of foot 22 of athlete 26.

Figure 2:
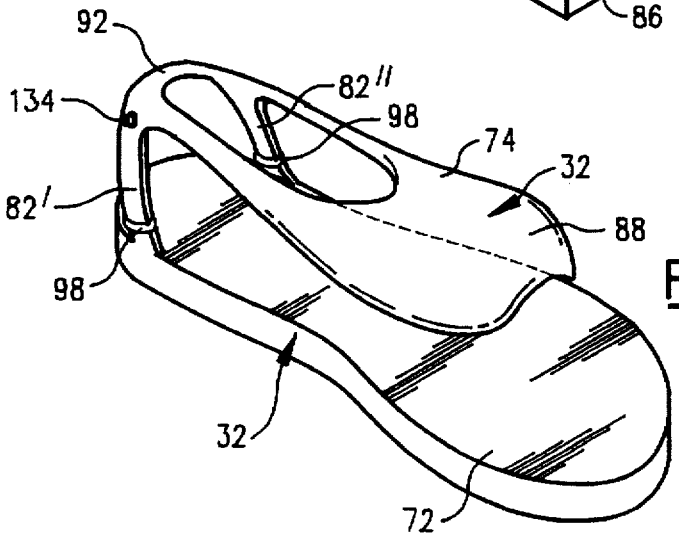
FIG. 2 is an isometric view of the lower bladder and upper bladder illustrated in FIG. 1.

FIGS. 3 and 4 illustrate lower bladder 72 of absorbing and redirecting means 32 being formed integrally within sole 84 of inner boot 30. Under these circumstances, a separate upper bladder 74 and conduits 82' and 82" would have to be somehow attached to the integrally formed lower bladder 72. Any adequate means for attaching upper bladder 74 to lower bladder 72 may be used. For example, as shown in FIG. 2, one or more simple tubular couplings 98 could be attached between conduits 82' and/or 82" and lower bladder 72. Alternatively, an inlet to upper bladder 74 could be adhered to an outlet of lower bladder 72, thereby eliminating the need for conduits 82' and 82".

Figure 6:
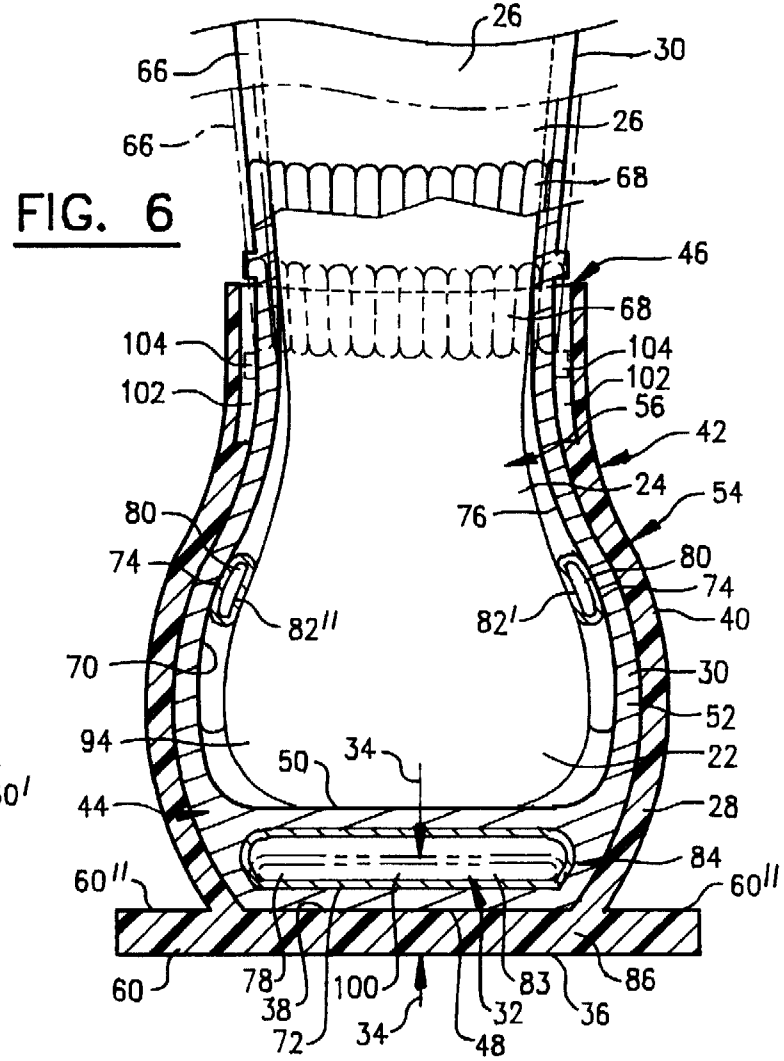
FIG. 6 is an enlarged, cross-sectional, rear-elevational view of the first embodiment of the invention taken substantially along line VI—VI of FIG. 5, further illustrating the use of the internal spring being released when the lower bladder is in an unloaded position (in solid lines) and being compressed when the lower bladder is in a loaded position (in dotted lines).
Figure 5:
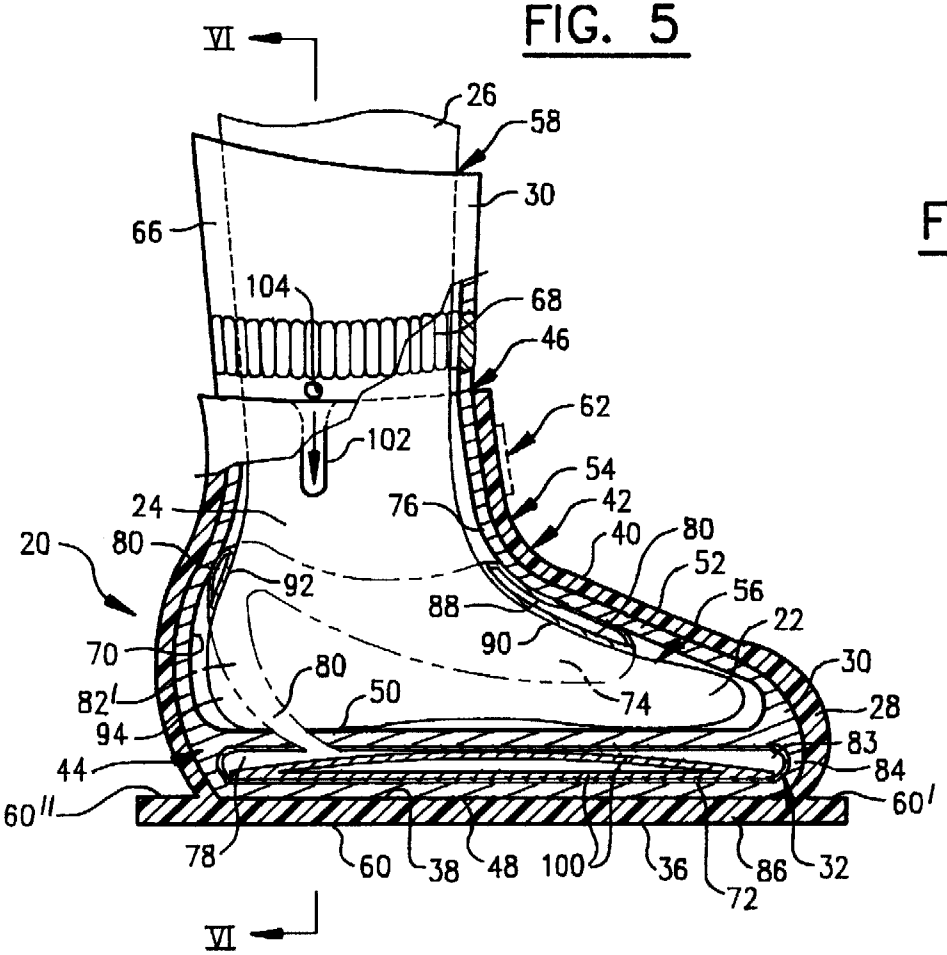
FIG. 5 is a cross-sectional, side-elevational view of the first embodiment of the invention as shown in FIG. 3 further illustrating the use of an internal spring to bias the lower bladder toward an unloaded position.

As illustrated in FIGS. 5 and 6, lower bladder 72 can further comprise an internal spring 100 to bias lower bladder 72 toward an unloaded position when absorbing and redirecting means 32 is also in an unloaded position. In essence, internal spring 100 would draw fluid 83 contained within conduits 82' and 82" and within interior cavity 80 of upper bladder 74 back down into interior cavity 78 of lower bladder 72 if impact compression force 34 is not being exerted upon lower bladder 72 between foot 22 and insole 50 of inner boot 30.

In addition to the above-mentioned use of lower bladder 72 and upper bladder 74 connected together via one or more conduits 82, the present invention also encompasses the use of additional means for securing the feet 22 of athlete 26 against undesired movement when experiencing a sudden impact.

For example, as shown in FIGS. 1, 3, 4, 5, 6, 7, 8, 9, 11, 12, 14, and 15, sidewalls 40 of outer boot 28 can be provided with at least one channel 102 or keyway therein. Inner boot 30 is then further provided with at least one corresponding pin 104 which is attached thereto or formed integrally therewith. When necessary, pin 104 of inner boot 30 can operably engage channel 102 of outer boot 28 to perform means of tracking and further joining inner boot 30 to outer boot 28.

It is intended that the coupling or engagement between pin 104 and channel 102 occurs when absorbing and redirecting means 32 is generally within its loaded position. Thus engaged, pin 104 and channel 102 restrict movement of inner boot 30 with respect to outer boot 28.

However, when absorbing and redirecting means 32 moves back to its unloaded position, pin 104 of inner boot 30 does not operably engage channel 102 of outer boot 28, thereby permitting additional freedom for athlete 26 to move inner boot 30 without unnecessary obstruction unless impact compression force 34 is being exerted.

Figure 7:
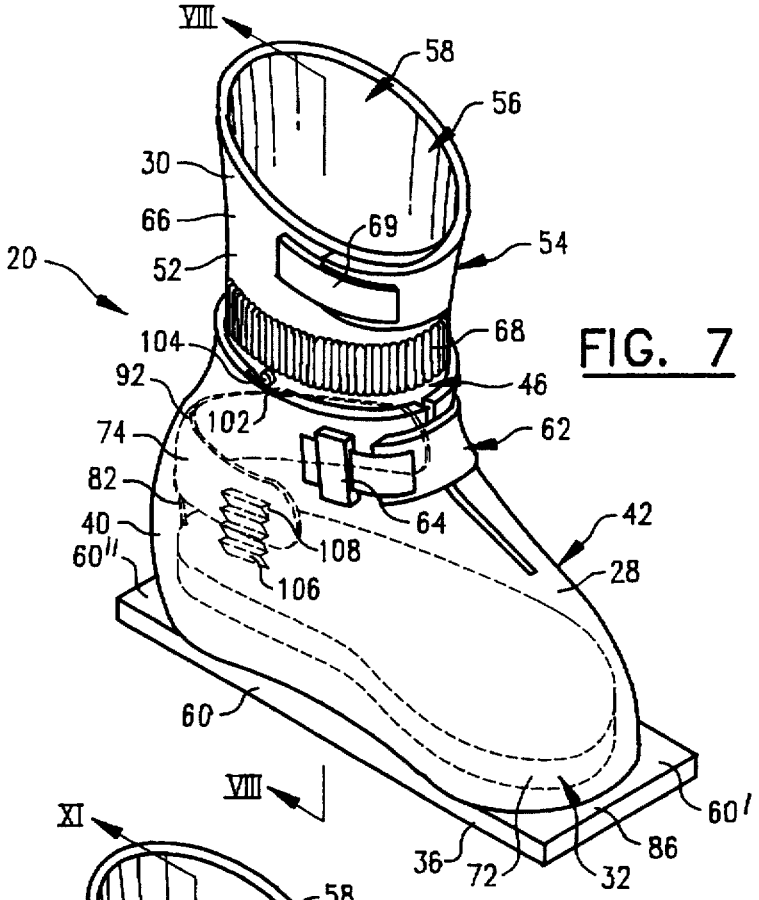
FIG. 7 is an isometric view of a second embodiment of the present invention illustrating alternative means for securing an inner boot against forward pivotal and vertical movement with respect to the outer boot when the lower bladder is in a loaded position.
Figure 9:
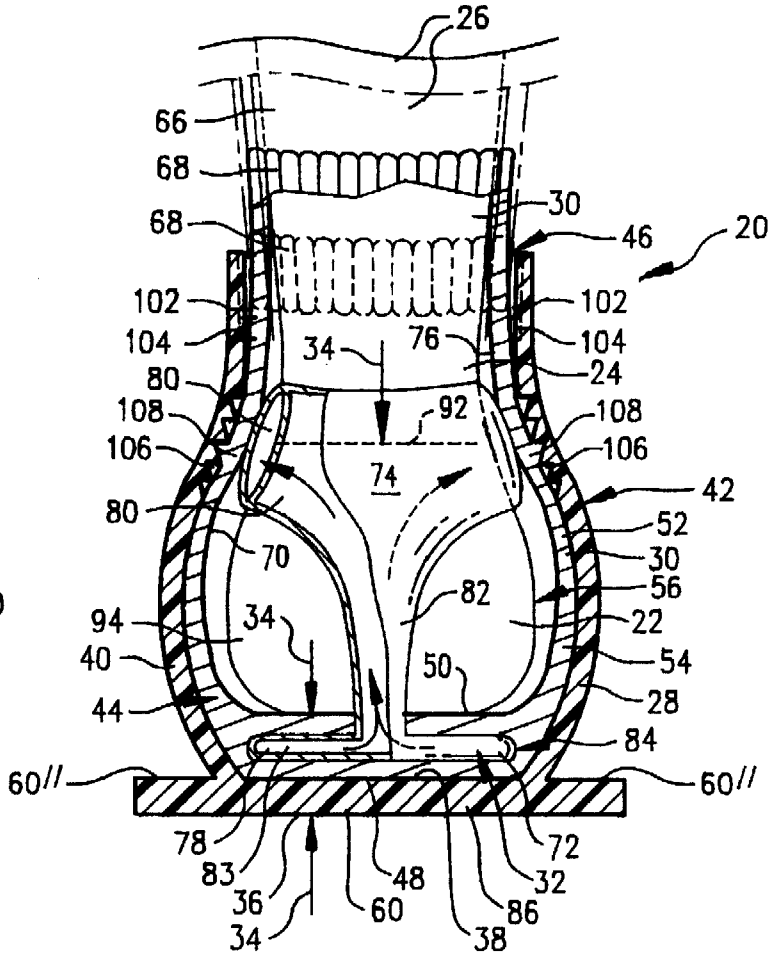
FIG. 9 is a cross-sectional, rear-elevational view of the second embodiment of the invention as shown in FIG. 8 illustrating the alternative securing means when the lower bladder is in a loaded position.
Figure 8:
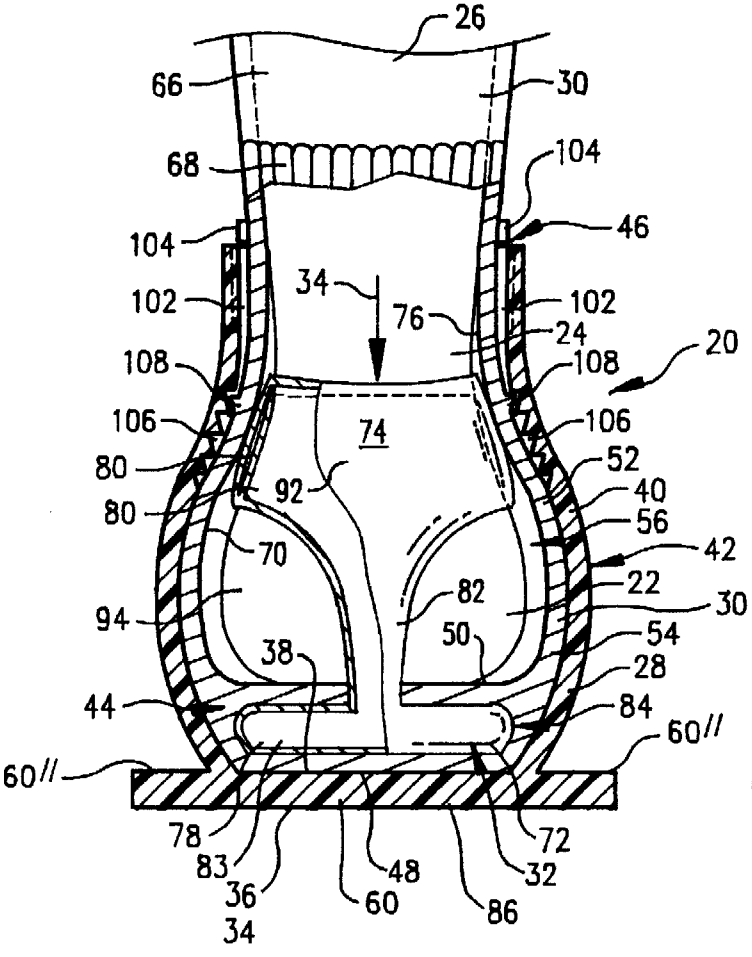
FIG. 8 is a cross-sectional, rear-elevational view of the second embodiment of the invention taken substantially along line VIII—VIII of FIG. 7, illustrating the alternative securing means when the lower bladder is in an unloaded position.

Within an alternative second embodiment of the present invention, as shown in FIGS. 7, 8, and 9, sidewalls 40 of outer boot 28 is provided with at least one ratchet portion 106, rack, or rail. FIGS. 8 and 9 illustrate the invention with a serrated ratchet portion 106 or rack. Inner boot 30 is then provided with at least one protrusion 108, knob, pin, or the like, which protrudes therefrom. Protrusion 108 of inner boot 30 is capable of operably engaging with ratchet portion 106 of outer boot 28 when absorbing and redirecting means 32 is in a loaded position. When thus engaged, protrusion 108 and ratchet portion 106 further restrict undesired movement of inner boot 30 with respect to outer boot 28.

As can be seen within FIG. 9, when absorbing and redirecting means 32 is activated and assumes its loaded position, the enlargement of upper bladder 74 urges protrusion 108 of inner boot 30 outwardly into fixed engagement with ratchet portion 106 of outer boot 28.

Conversely, and partially due to the resiliency of inner boot 30 and of outer boot 28, when absorbing and redirecting means 32 assumes its unloaded position, protrusion 108 of inner boot 30 does not operably engage with ratchet portion 106 of outer boot 28.

Of course, the particular configuration of ratchet portion 106 and of protrusion 108 is not necessarily as important as a dramatically increased frictional contact between these two elements when lower bladder 72 assumes its loaded position.

Figure 10:
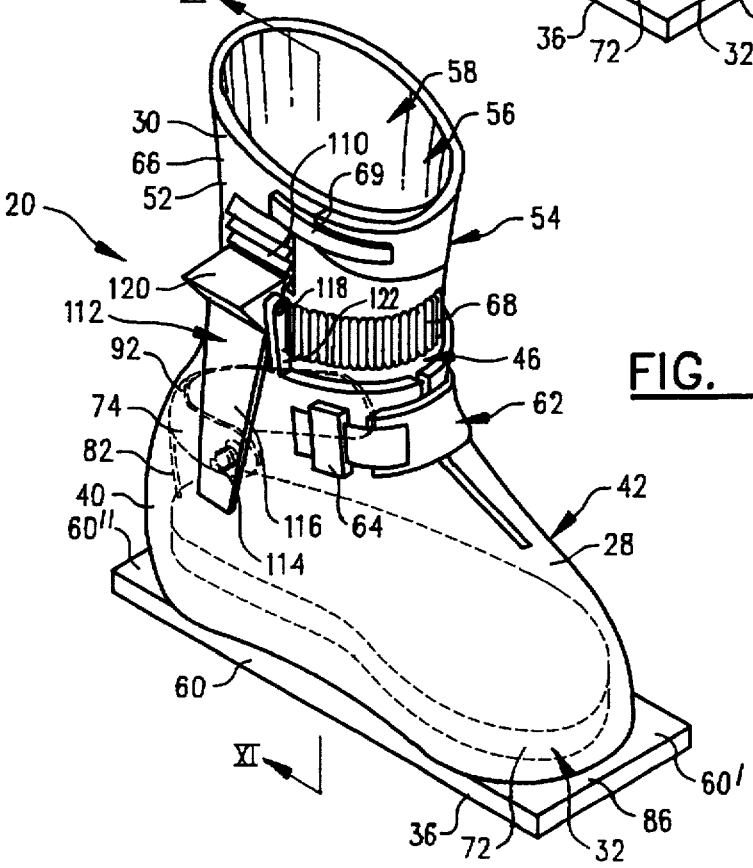
FIG. 10 is an isometric view of a third embodiment of the present invention illustrating further alternative means for securing an inner boot against vertical movement with respect to the outer boot when the lower bladder is in a loaded position.
Figure 11:
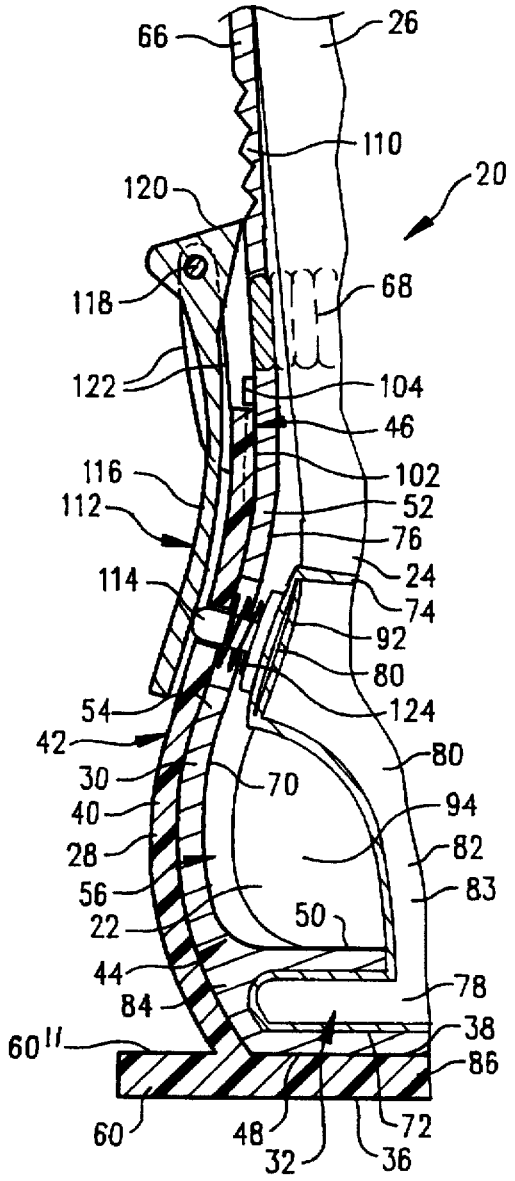
FIG. 11 is an enlarged, partial, cross-sectional, front-elevational view of the third embodiment of the invention taken substantially along line XI—XI of FIG. 10, illustrating the further alternative securing means when the lower bladder is in an unloaded position.
Figure 12:
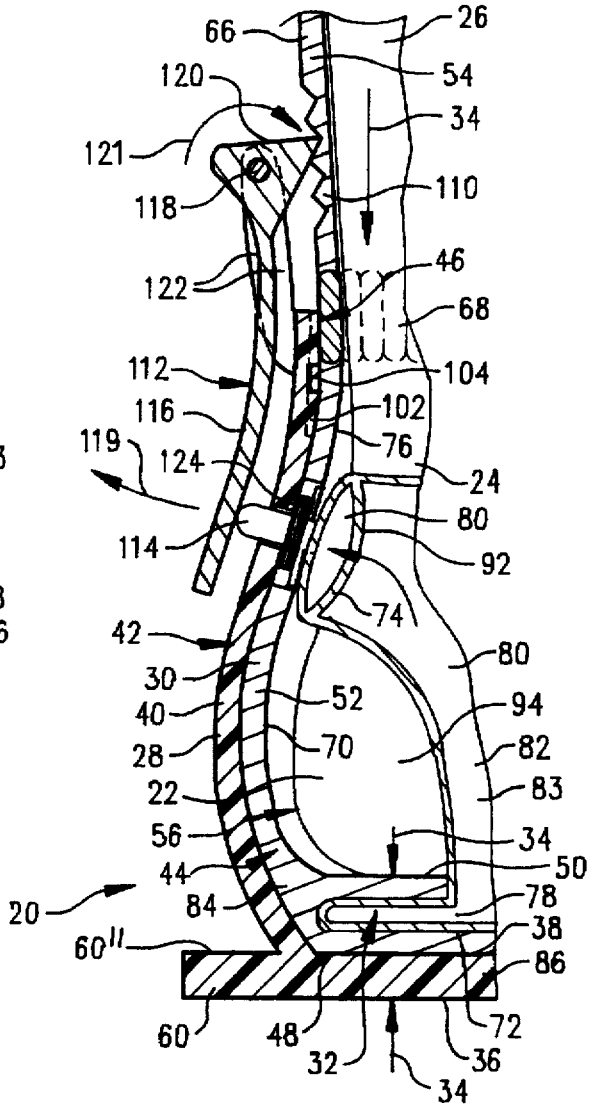
FIG. 12 is an enlarged, partial, cross-sectional, front-elevational view of the third embodiment of the invention as shown in FIG. 11 illustrating the further alternative securing means when the lower bladder is in a loaded position.

Within an alternative third embodiment of the present invention, as shown in FIGS. 10, 11, and 12, sidewalls 52 of inner boot 30 are provided with at least one ratchet portion 110 or rack. FIGS. 10, 11, and 12 illustrate the invention with a serrated ratchet portion 110 or rack. Outer boot 28 is then provided with at least one pivotal crank 112, or clamp, or the like, which protrudes therefrom. Pivotal crank 112 of outer boot 28 is capable of operably engaging with ratchet portion 110 of inner boot 30 when absorbing and redirecting means 32 is in a loaded position. When thus engaged, pivotal crank 112 and ratchet portion 110 of inner boot 30 further restrict movement of inner boot 30 with respect to outer boot 28.

As can be seen within FIG. 12, when absorbing and redirecting means 32 is activated and assumes it loaded position, enlargement of upper bladder 74 urges a piston 114 outwardly, thereby also pushing a lower portion 116 of pivotal crank 112 of outer boot 28 outwardly. This action causes pivotal crank 112 to pivot about a fulcrum 118, pivot pin, or axle in a direction indicated by arrow 119 and urges an upper portion 120 of pivotal crank 112 of outer boot 28 inwardly in a direction indicated by arrow 121 into fixed engagement with ratchet portion 110 of inner boot 30, thereby preventing movement of outer boot 28 with respect to inner boot 30.

Of course, fulcrum 118 is securely attached to outer boot 28 by any appropriate means such as by using outwardly and/or upwardly projecting flanges 122. However, flanges 122 and fulcrum 118 still permit pivotal action of pivotal crank 112 to occur.

Conversely, when absorbing and redirecting means 32 assumes its unloaded position, a spring 124 urges piston 114 inwardly away from lower portion 116 of pivotal crank 112 of outer boot 28. The pressure exerted by the ratchet system of inner boot 30 pushes upper portion 120 of pivotal crank 112 outwardly therefrom. Consequently, pivotal crank 112 of outer boot 28 does not operably engage with ratchet portion 110 of inner boot 30 when absorbing and redirecting means 32 is deactivated and/or assumes it unloaded position.

Figure 13:
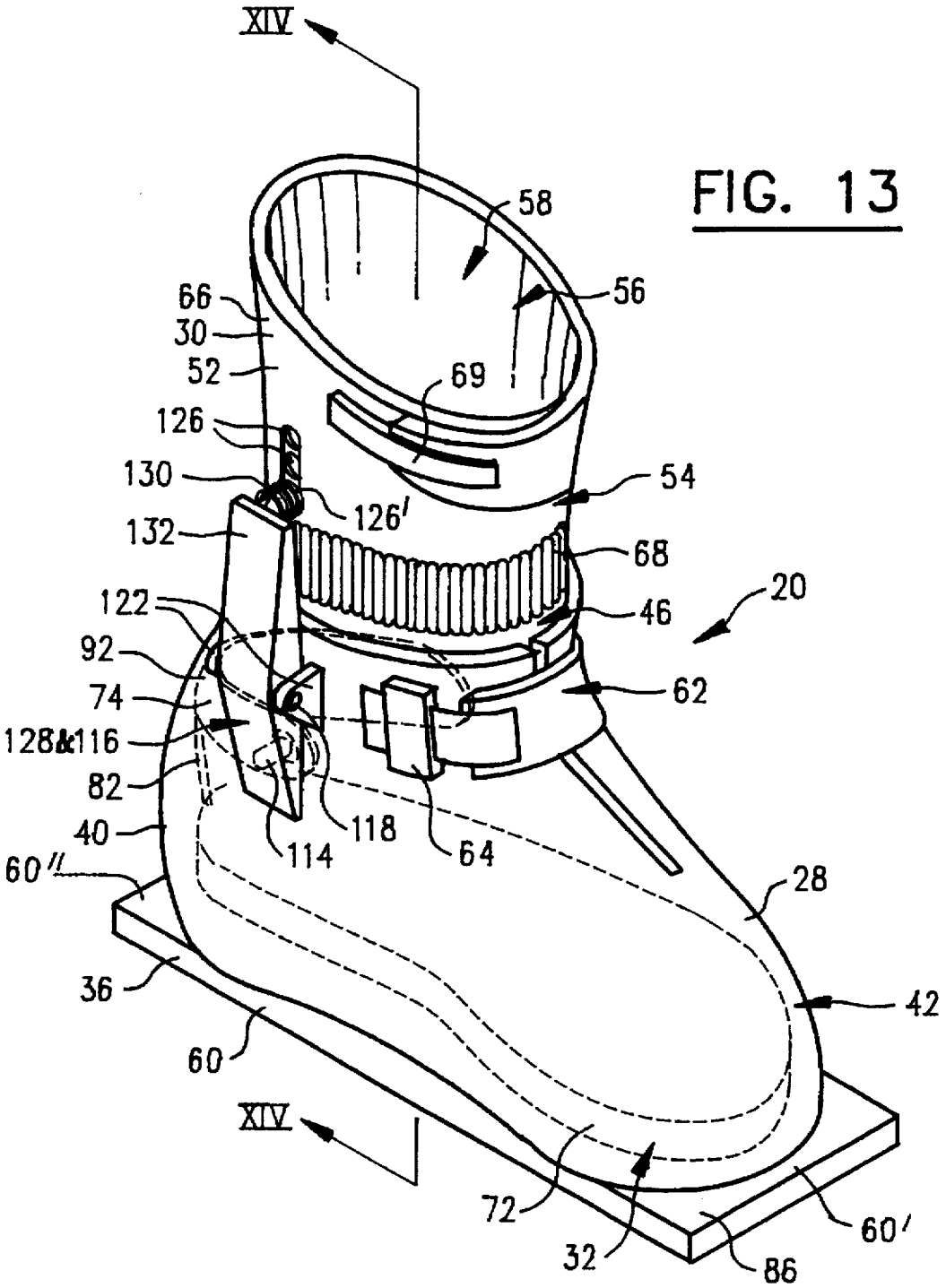
FIG. 13 is an isometric view of a fourth embodiment of the present invention illustrating further alternative means for securing an inner boot against pivotal and vertical movement with respect to the outer boot when the lower bladder is in a loaded position.
Figure 14:
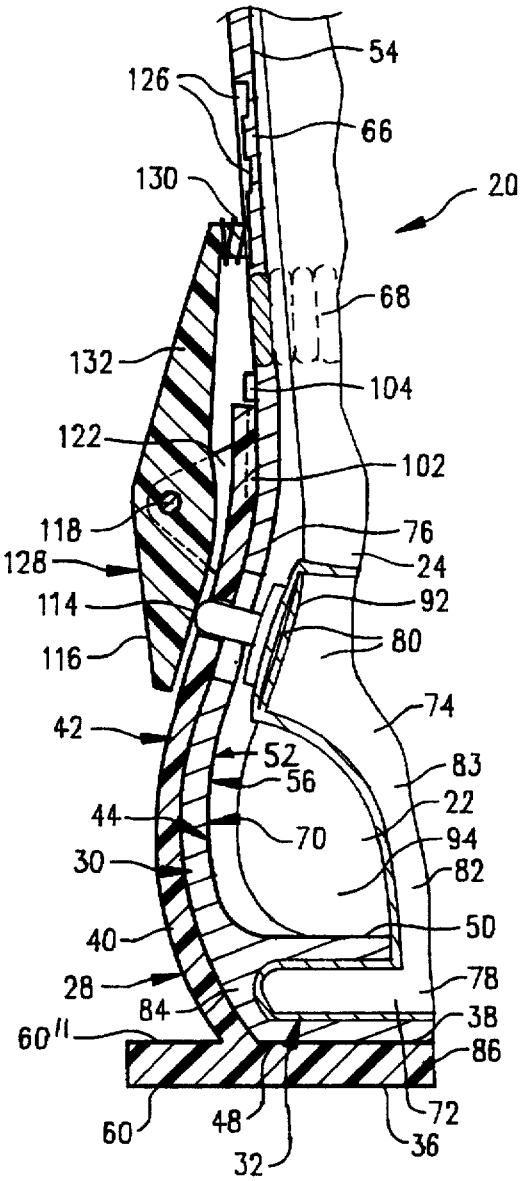
FIG. 14 is an enlarged, partial, cross-sectional, front-elevational view of the fourth embodiment of the invention taken substantially along line XIV—XIV of FIG. 13, illustrating the further alternative securing means when the lower bladder is in an unloaded position.
Figure 15:
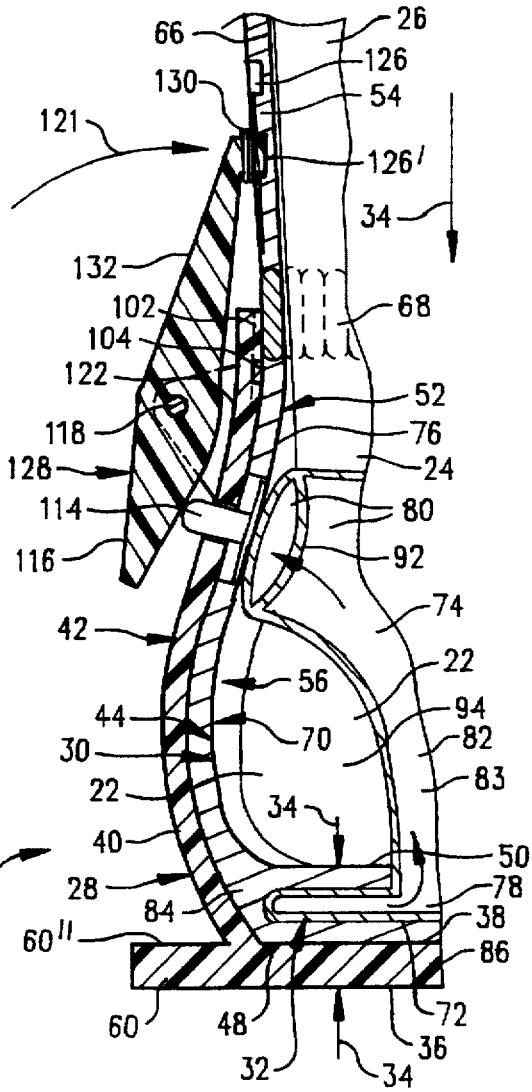
FIG. 15 is an enlarged, partial, cross-sectional, front-elevational view of the fourth embodiment of the invention as shown in FIG. 14 illustrating the further alternative securing means when the lower bladder is in a loaded position.

Within an alternative fourth embodiment of the present invention, sidewalls 52 of inner boot 30 are provided with a plurality of linearly spaced indentations 126, holes, or the like. FIGS. 13, 14, and 15 illustrate the invention using linearly spaced indentations 126, holes, or the like. Outer boot 28 is then provided with at least one pivotal crank 128, or the like, which protrudes therefrom. Pivotal crank 128 of outer boot 28 is capable of being aligned to, mated with, and operably engaging with at least one of the plurality of linerally spaced indentations 126 of inner boot 30 when absorbing and redirecting means 32 is in a loaded position.

When thus engaged, pivotal crank 128 and the engaged indentation 126' further restrict movement of inner boot 30 with respect to outer boot 28. In essence, absorbing and redirecting means 32 urges pivotal crank 128 of outer boot 28 into fixed engagement with at least one of the plurality of linerally spaced indentations 126 of inner boot 30 when absorbing and redirecting means 32 is in its loaded position.

Conversely, when absorbing and redirecting means 32 assumes its unloaded position, a spring 130 urges an upper portion 132 of pivotal crank 128 outwardly away from inner boot 30 thereby disengaging the previously engaged indentation 126'. Pivotal crank 128 would no longer be urged outwardly by the expansion of upper bladder 74. Consequently, pivotal crank 128 of outer boot 28 would not operably engage with the indentations 126 of inner boot 30 when absorbing and redirecting means 32 is deactivated and assumes it unloaded position.

As shown in FIG. 2, fluid 83 contained within the bladder assembly can be fed into or bled from a insert port or bleed hole 134 to accommodate a wide variety of differently sized and contoured feet 22.

The means and construction disclosed herein are by way of example and comprise primarily the preferred and some alternative forms of putting the invention into effect. Although the drawings depict the preferred and several alternative embodiments of the invention, other embodiments have been described within the preceding text. One skilled in the art will appreciate that the disclosed device may have a wide variety of shapes and configurations. Additionally, persons skilled in the art to which the invention pertains might consider the foregoing teachings in making various modifications, other embodiments, and alternative forms of the invention.

For example, many other variations of the invention are possible including means for which inner boot 30 interlocks within outer boot 28 to provide support and stability of foot 22. The medium for transferring the impact energy can also take on different forms or embodiments, such as by using a piston assembly or a pre-loaded accumulator to transfer applied operational weight into ankle support and stability. The primary features of such means being the ability to draw and hold foot 22 and ankle 24 of athlete 26 together in a locked and loaded manner. Different manufacturing techniques could also be employed to form the bladder assembly with other parts of the boot so as not to be removable from either inner boot 30 or outer boot 28.

Furthermore, the above-described and illustrated embodiments primarily focus of snowboard boots and ski boots which may incorporate the present invention. However, the present invention could be applied or incorporated into other shoes and/or boots to gain ankle support and stability by the transfer of applied operational weight. Similarly, the bladder assembly could be constructed with other shapes so as to conform with various different applications.

It is, therefore, to be understood that the invention is not limited to the particular embodiments or specific features shown herein. To the contrary, the inventor claims the invention in all of its forms, including all modifications, equivalents, and alternative embodiments which fall within the legitimate and valid scope of the appended Claims, appropriately interpreted under the Doctrine Of Equivalents.

INDUSTRIAL APPLICABILITY

The present invention may be used within many sports, including but not limited to, snowboarding, snow skiing, and the like. In essence, the present invention may be used wherever simple, reliable, easily used apparatus and methods are needed to protect the feet and ankles of athletes when exposed to excessive shock and/or impact compression forces. For example, the present invention permits relaxed maneuverability within the boot as the athlete is performing various maneuvers. However, upon receiving an excessive impact compression force, such as occurs upon landing after performing an airborne maneuver, the improved boot of the present invention absorbs the landing impact compression forces and redirects such forces and energy attendant thereto to provide additional, variable support for the athlete's feet and ankles.

It is intended that when the present invention is used, injuries will be prevented and the performance of athletes within the snowboarding and snow skiing sports will be greatly enhanced.

Furthermore, operation of the present invention occurs automatically upon receiving such an impact. Consequently, this invention does not require continuous alteration to accommodate traditional and/or nontraditional snowboarding and/or snow skiing techniques as currently used within such sports.

The apparatus of this invention is compact, efficient, reusable, durable, rugged, is easily constructed, and is inexpensive and economical to manufacture.

The present invention has a special benefit in allowing its use with a wide variety of differently sized athletes. Not only can the boot be manufactured in many different sizes, but the lower bladder and/or the upper bladder contained within any particular size of boot can be bled through a bleed hole or otherwise adjusted to accommodate half sizes and differently contoured feet.

The present invention may be used with conventional bindings or means for attaching the boot to the snowboard and/or snow ski. Consequently, there is no need to modify, alter, or deface the snowboard or ski to achieve the purposes of this invention.

I claim:

1. An improved athletic boot for placement upon a foot of an athlete, said improved athletic boot comprising:

(a) an outer boot having an exterior outsole, an opposed interior insole, and attached sidewalls, said sidewalls defining a boot upper for said outer boot, said interior insole and sidewalls of said outer boot defining a first enclosure, said outer boot having an opening into said first enclosure;

(b) an inner boot positioned within said first enclosure, an inner boot having an outsole, an opposed insole, and attached sidewalls, said sidewalls defining a boot upper for said inner boot, said insole and sidewalls of said inner boot defining a second enclosure capable of receiving the foot of the athlete, said inner boot having an opening into said second enclosure;

(c) means for absorbing and redirecting impact compression force exerted upon said outsole of said outer boot to provide additional support for the foot of the athlete, said absorbing and redirecting means having (i) an inflatable lower bladder positioned between said insole of said inner boot and said outsole of said outer boot, and (ii) an inflatable upper bladder positioned between an interior surface of said sidewalls of said outer boot and the foot of the athlete when said improved athletic boot is worn, an interior of said lower bladder in communication with an interior of said upper bladder (d) wherein said outer boot further comprises means for at least partially tightening said opening into said first enclosure;

(e) wherein said inner boot further comprises an elongated cuff which extends above an ankle of the athlete when said improved athletic boot is worn, said cuff of said inner boot extending above said opening into said first enclosure of said outer boot;

(f) wherein said elongated cuff of said inner boot further comprises a flexible portion which permits the athlete to lean forward when wearing the improved athletic boot, said flexible portion of said inner boot positioned at least partially above said opening into said first enclosure of said outer boot when said absorbing and redirecting means is in an unloaded position, said flexible portion of said inner boot positioned at least partially below said opening into said first enclosure of said outer boot when said absorbing and redirecting means is in a loaded position.

2. The improved athletic boot of claim 1, wherein said outer boot comprises a snowboard boot attachable to a snowboard, said outsole of said outer boot having a forwardly projecting and rearwardly projecting sole plate attachable to a binding of the snowboard.

3. The improved athletic boot of claim 1, wherein said opening into said first enclosure of said outer boot is positioned above an ankle of the athlete when said improved athletic boot is worn.

4. The improved athletic boot of claim 1, wherein said inner boot further comprises means for cushioning the foot of the athlete.

5. The improved athletic boot of claim 1, wherein said absorbing and redirecting means is at least partially juxtaposed between said outer boot and said inner boot.

6. The improved athletic boot of claim 1, wherein said inflatable upper bladder is positioned at least partially over an arch of the foot of the athlete.

7. The improved athletic boot of claim 1, wherein said inflatable upper bladder is positioned at least partially over a heel of the foot of the athlete.

8. The improved athletic boot of claim 1, wherein said inflatable upper bladder is positioned at least partially under the ankle of the foot of the athlete.

9. The improved athletic boot of claim 1, wherein said absorbing and redirecting means is at least partially attached to said inner boot.

10. The improved athletic boot of claim 9, wherein said lower bladder is at least partially attached to said inner boot between said insole and said outsole of said inner boot.

11. The improved athletic boot of claim 1, wherein said lower bladder further comprises an internal spring to bias said lower bladder toward an unloaded position when said absorbing and redirecting means is in an unloaded position.

12. The improved athletic boot of claim 1, wherein said absorbing and redirecting means is at least partially formed integrally within said inner boot.

13. The improved athletic boot of claim 1, wherein said lower bladder is at least partially formed integrally within said inner boot between said insole and said outsole of said inner boot.

14. The improved athletic boot of claim 1, wherein said sidewalls of said outer boot are provided with at least one ratchet portion, said inner boot further comprising at least one protrusion, said provision of said inner boot operably engageable with said ratchet portion of said outer boot when said absorbing and redirecting means is in a loaded position thereby restricting movement of said inner boot with respect to said outer boot, said absorbing and redirecting means urging said protrusion of said inner boot into fixed engagement with said ratchet portion of said outer boot when said absorbing and redirecting means is in said loaded position, said protrusion of said inner boot operably disengageable with said ratchet portion of said outer boot when said absorbing and redirecting means is in an unloaded position.

15. The improved athletic boot of claim 1, wherein said sidewalls of said inner boot are provided with at least one ratchet portion, said outer boot further comprising at least one pivotal crank, said pivotal crank of said outer boot operably engageable with said ratchet portion of said inner boot when said absorbing and redirecting means is in a loaded position thereby restricting movement of said inner boot with respect to said outer boot, said absorbing and redirecting means urging said pivotal crank of said outer boot into fixed engagement with said ratchet portion of said inner boot when said absorbing and redirecting means is in said loaded position, said pivotal crank of said outer boot operably disengageable with said ratchet portion of said inner boot when said absorbing and redirecting means is in an unloaded position.

16. The improved athletic boot of claim 1, wherein said sidewalls of said inner boot are provided with a plurality of linearly spaced indentations, said outer boot further comprising at least one pivotal crank, said pivotal crank of said outer boot operably engageable with at least one of said plurality of linerally spaced indentations of said inner boot when said absorbing and redirecting means is in a loaded position thereby restricting movement of said inner boot with respect to said outer boot, said absorbing and redirecting means urging said pivotal crank of said outer boot into fixed engagement with at least one of said plurality of linerally spaced indentations of said inner boot when said absorbing and redirecting means is in said loaded position, said pivotal crank of said outer boot operably disengageable with said plurality of linerally spaced indentations of said inner boot when said absorbing and redirecting means is in an unloaded position.

17. An improved athletic boot for placement upon a foot of an athlete, said improved athletic boot comprising:

(a) an outer boot having an exterior outsole, an opposed interior insole, and attached sidewalls, said sidewalls defining a boot upper for said outer boot, said interior insole and sidewalls of said outer boot defining a first enclosure, said outer boot having an opening into said first enclosure;

(b) an inner boot positioned within said first enclosure, an inner boot having an outsole, an opposed insole, and attached sidewalls, said sidewalls defining a boot upper for said inner boot, said insole and sidewalls of said inner boot defining a second enclosure capable of receiving the foot of the athlete, said inner boot having an opening into said second enclosure;

(c) means for absorbing and redirecting impact compression force exerted upon said outsole of said outer boot to provide additional support for the foot of the athlete, said absorbing and redirecting means having (i) an inflatable lower bladder positioned between said insole of said inner boot and said outsole of said outer boot, and (ii) an inflatable upper bladder positioned between an interior surface of said sidewalls of said outer boot and the foot of the athlete when said improved athletic boot is worn, an interior of said lower bladder in communication with an interior of said upper bladder;

(d) wherein said outer boot further comprises means for at least partially tightening said opening into said first enclosure;

(e) wherein said inner boot further comprises an elongated cuff which extends above an ankle of the athlete when said improved athletic boot is worn, said cuff of said inner boot extending above said opening into said first enclosure of said outer boot;

(f) wherein said sidewalls of said outer boot are provided with at least one channel therein, said inner boot further comprising at least one pin therein, said pin of said inner boot operably engageable with said channel of said outer boot when said absorbing and redirecting means is in a loaded position thereby restricting movement of said inner boot with respect to said outer boot, said pin of said inner boot operably disengageable with said channel of said outer boot when said absorbing and redirecting means is in an unloaded position.

18. The improved athletic boot of claim 17, wherein said outer boot comprises a snowboard boot attachable to a snowboard, said outsole of said outer boot having a forwardly projecting and rearwardly projecting sole plate attachable to a binding of the snowboard.

19. The improved athletic boot of claim 17, wherein said opening into said first enclosure of said outer boot is positioned above an ankle of the athlete when said improved athletic boot is worn.

20. The improved athletic boot of claim 17, wherein said inner boot further comprises means for cushioning the foot of the athlete.

21. The improved athletic boot of claim 17, wherein said absorbing and redirecting means is at least partially juxtaposed between said outer boot and said inner boot.

22. The improved athletic boot of claim 17, wherein said inflatable upper bladder is positioned at least partially over an arch of the foot of the athlete.

23. The improved athletic boot of claim 17, wherein said inflatable upper bladder is positioned at least partially over a heel of the foot of the athlete.

24. The improved athletic boot of claim 17, wherein said inflatable upper bladder is positioned at least partially under the ankle of the foot of the athlete.

25. The improved athletic boot of claim 17, wherein said absorbing and redirecting means is at least partially attached to said inner boot.

26. The improved athletic boot of claim 25, wherein said lower bladder is at least partially attached to said inner boot between said insole and said outsole of said inner boot.

27. The improved athletic boot of claim 17, wherein said lower bladder further comprises an internal spring to bias said lower bladder toward an unloaded position when said absorbing and redirecting means is in an unloaded position.

28. The improved athletic boot of claim 17, wherein said absorbing and redirecting means is at least partially formed integrally within said inner boot.

29. The improved athletic boot of claim 17, wherein said lower bladder is at least partially formed integrally within said inner boot between said insole and said outsole of said inner boot.

30. The improved athletic boot of claim 17, wherein said sidewalls of said outer boot are provided with at least one ratchet portion, said inner boot further comprising at least one protrusion, said provision of said inner boot operably engageable with said ratchet portion of said outer boot when said absorbing and redirecting means is in a loaded position thereby restricting movement of said inner boot with respect to said outer boot, said absorbing and redirecting means urging said protrusion of said inner boot into fixed engagement with said ratchet portion of said outer boot when said absorbing and redirecting means is in said loaded position, said protrusion of said inner boot operably disengageable with said ratchet portion of said outer boot when said absorbing and redirecting means is in an unloaded position.

31. The improved athletic boot of claim 17, wherein said sidewalls of said inner boot are provided with at least one ratchet portion, said outer boot further comprising at least one pivotal crank, said pivotal crank of said outer boot operably engageable with said ratchet portion of said inner boot when said absorbing and redirecting means is in a loaded position thereby restricting movement of said inner boot with respect to said outer boot, said absorbing and redirecting means urging said pivotal crank of said outer boot into fixed engagement with said ratchet portion of said inner boot when said absorbing and redirecting means is in said loaded position, said pivotal crank of said outer boot operably disengageable with said ratchet portion of said inner boot when said absorbing and redirecting means is in an unloaded position.

32. The improved athletic boot of claim 17, wherein said sidewalls of said inner boot are provided with a plurality of linearly spaced indentations, said outer boot further comprising at least one pivotal crank, said pivotal crank of said outer boot operably engageable with at least one of said plurality of linerally spaced indentations of said inner boot when said absorbing and redirecting means is in a loaded position thereby restricting movement of said inner boot with respect to said outer boot, said absorbing and redirecting means urging said pivotal crank of said outer boot into fixed engagement with at least one of said plurality of linerally spaced indentations of said inner boot when said absorbing and redirecting means is in said loaded position, said pivotal crank of said outer boot operably disengageable with said plurality of linerally spaced indentations of said inner boot when said absorbing and redirecting means is in an unloaded position.

* * * * *

UNITED STATES PATENT AND TRADEMARK OFFICE

CERTIFICATE OF CORRECTION

PATENT NO : 5,692,321

DATED : December 2, 1997

INVENTOR(S) : Michael P. Holstine

It is certified that error appears in the above-identified patent and that said Letters Patent is hereby corrected as shown below:

Column 3, line 37, delete "effect" and insert therefor --affect--.

Column 5, line 52, delete "addition" and insert therefor --additional--.

Column 7, line 33, delete "linerally" and insert therefor --linearly--.

Column 11, lines 41-42, delete "a pair or more of".

Column 14, line 21, delete "is provided" and insert therefor --are provided--.

Column 14, line 60, delete "it loaded" and insert therefor --its loaded--.

Column 15, line 27, delete "linerally" and insert therefor --linearly--.

Column 15, line 35, delete "linerally" and insert therfor --linearly--.

Column 18, line 27, delete "provision" and insert therefor --protrusion--.

UNITED STATES PATENT AND TRADEMARK OFFICE

CERTIFICATE OF CORRECTION

PATENT NO : 5,692,321

DATED : December 2, 1997

INVENTOR(S): Michael P. Holstine

It is certified that error appears in the above-identified patent and that said Letters Patent is hereby corrected as shown below:

Column 18, line 58, delete "lineraily" and insert therefor --linearly--.

Column 18, line 64, delete "linerally" and insert therefor --linearly--.

Column 18, line 67, delete "linerally" and insert therefor --linearly--.

Column 20, line 24, delete "provision" and insert therefor --protrusion--.

Signed and Sealed this

Seventeenth Day of February, 1998

Bruce Lehman

*Attest:*

BRUCE LEHMAN

*Attesting Officer*

*Commissioner of Patents and Trademarks*